US005825381A

United States Patent [19]

Choo

[11] Patent Number: 5,825,381

[45] Date of Patent: Oct. 20, 1998

[54] HOME POSITION SENSOR SYSTEM FOR POSITIONING PRINT CARRIAGE AND METHOD THEREOF

[75] Inventor: Jong-Yang Choo, Seoul, Rep. of Korea

[73] Assignee: SamSung Electronics Co., Ltd., Suwon, Rep. of Korea

[21] Appl. No.: 728,696

[22] Filed: Oct. 10, 1996

[30] Foreign Application Priority Data

Oct. 18, 1995 [KR] Rep. of Korea ..... 1995/35969

[51] Int. Cl.[6] ..... B41J 23/00

[52] U.S. Cl. ..... 347/37; 347/19; 347/5

[58] Field of Search ..... 347/5, 9, 19, 37, 347/8; 400/216.1, 216.2, 216.3

[56] References Cited

U.S. PATENT DOCUMENTS

| | | | |
|---|---|---|---|
| 4,626,867 | 12/1986 | Furukawa et al. . | |
| 4,739,847 | 4/1988 | Terasawa . | |
| 4,922,270 | 5/1990 | Cobbs et al. . | |
| 5,109,239 | 4/1992 | Cobbs et al. . | |
| 5,112,150 | 5/1992 | Iwata | 400/216.1 |
| 5,289,208 | 2/1994 | Haselby . | |
| 5,428,380 | 6/1995 | Ebisawa . | |
| 5,451,990 | 9/1995 | Sorenson et al. . | |

*Primary Examiner*—Benjamin R. Fuller
*Assistant Examiner*—Juanita Stephens
*Attorney, Agent, or Firm*—Robert E. Bushnell, Esq.

[57] ABSTRACT

A home position sensor system and method capable of shortening the amount of time consumed for sensing a home position. The home position sensor system including a carriage wherein a recording head is mounted and being movable in a horizontal direction, two sensing ribs separated by a constant interval from each other along the moving direction of the carriage and protrudedly formed in the carriage, a home sensor provided at one side cad of a moving path of the carriage to thereby correspond to the sensing ribs, a carriage driver for moving the carriage, and a controller for moving the carriage in a horizontal direction through the carriage driver in accordance with sensing states of the home sensor to the two sensing ribs to thereby sense a home position.

24 Claims, 7 Drawing Sheets

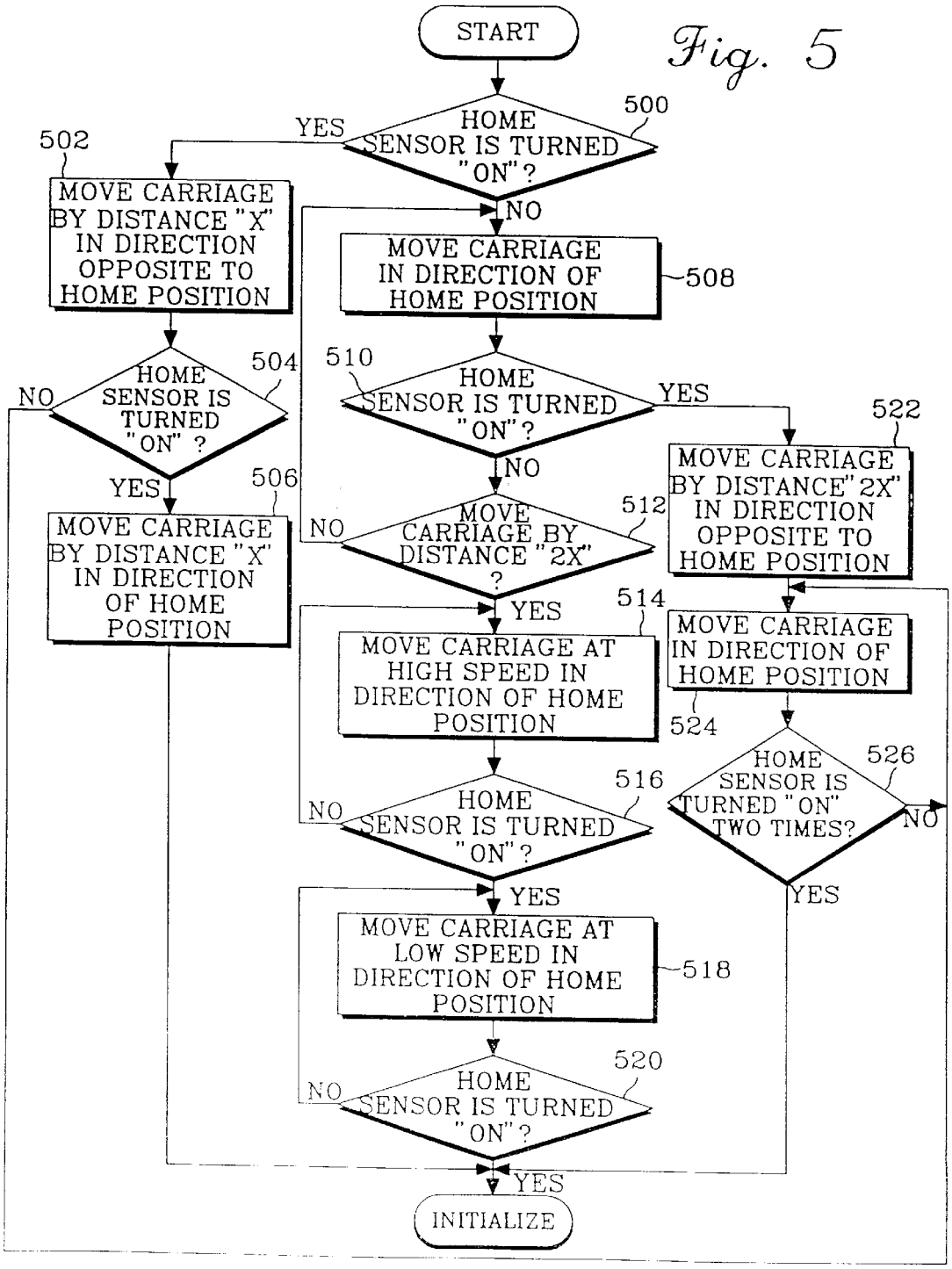
START
Fig. 5
HOME SENSOR IS TURNED "ON"?
500
YES
NO
502
MOVE CARRIAGE BY DISTANCE "X" IN DIRECTION OPPOSITE TO HOME POSITION
MOVE CARRIAGE IN DIRECTION OF HOME POSITION
508
HOME SENSOR IS TURNED "ON" ?
504
NO
YES
506
MOVE CARRIAGE BY DISTANCE "X" IN DIRECTION OF HOME POSITION
510
HOME SENSOR IS TURNED "ON"?
YES
NO
522
MOVE CARRIAGE BY DISTANCE "2X" IN DIRECTION OPPOSITE TO HOME POSITION
MOVE CARRIAGE BY DISTANCE "2X" ?
512
NO
YES
514
MOVE CARRIAGE AT HIGH SPEED IN DIRECTION OF HOME POSITION
MOVE CARRIAGE IN DIRECTION OF HOME POSITION
524
HOME SENSOR IS TURNED "ON" TWO TIMES?
526
NO
YES
HOME SENSOR IS TURNED "ON"?
516
NO
YES
MOVE CARRIAGE AT LOW SPEED IN DIRECTION OF HOME POSITION
518
HOME SENSOR IS TURNED "ON"?
520
NO
YES
INITIALIZE

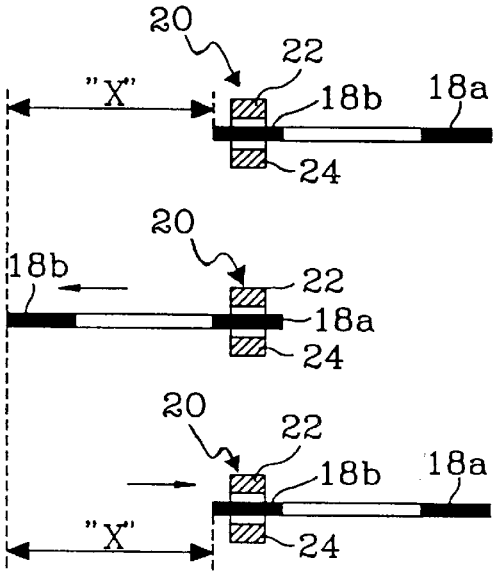
Fig. 6A
Fig. 6B
Fig. 6C
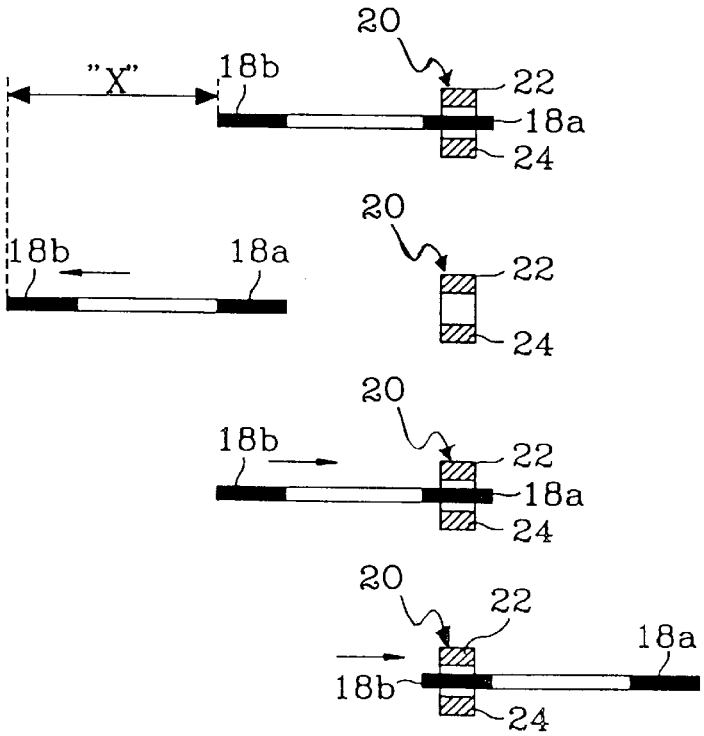
Fig. 7A
Fig. 7B
Fig. 7C
Fig. 7D

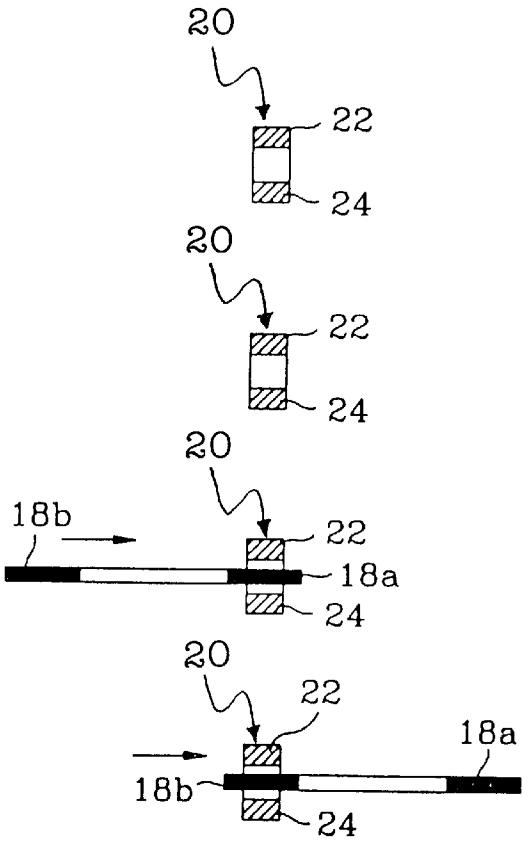
Fig. 9A
Fig. 9B
Fig. 9C
Fig. 9D
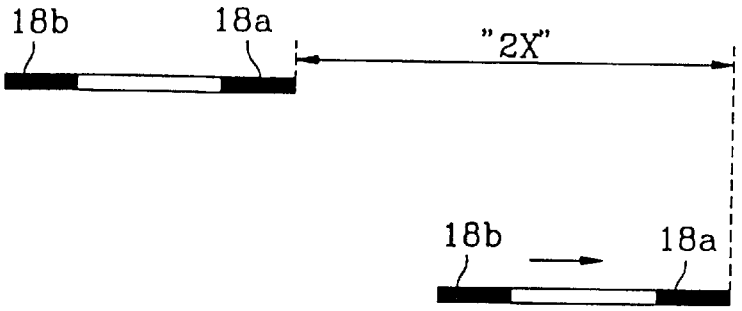

HOME POSITION SENSOR SYSTEM FOR POSITIONING PRINT CARRIAGE AND METHOD THEREOF

CROSS-REFERENCE TO RELATED APPLICATION

This application makes reference to, incorporates the same herein, and claims all benefits accruing under 35 U.S.C. §119 from an application for *Home Position Sensing Device And Method Thereof* earlier filed in the Korean Industrial Property Office on 18 Oct. 1995, and there duly assigned Ser. No. 35969/1995.

BACKGROUND OF THE INVENTION

1. Technical Field

The present invention relates to a home position sensor system, and more particularly to a home position sensor system for sensing a home position as an initial reference position for each scan axis direction and positioning a print carriage at the home position for beginning printing information on a recording medium in each scan axis direction.

2. Background Art

Conventional printer such as a dot matrix printer, inkjet printer and plotter includes a recording head having an array of inkjet nozzles mounted on a carriage for printing a plurality of rows of dots in a single scan of a movable print carriage across a print medium. Inkjet technology is well known in the art as represented, for example, in U.S. Pat. No. 4,626,867 for *Method For Preventing Unregistered Printing In Multi-Nozzle Ink Jet Printing* issued to Furukawa et al., U.S. Pat. No. 4,872,027 for *Printer Having Identifiable Interchangeable Heads* issued to W. A. Buskirk et al., and U.S. Pat. No. 4,965,593 for *Print Quality Of Dot Printers* issued to M. S. Hickman.

The recording head is typically mounted in a print cartridge within an assembly that is mounted on the carriage of the printer/plotter. Generally, full color or black and white printing or plotting requires that the carriage supporting the recording head be precisely aligned or positioned at an initial home position serving as a reference position so as to accurately begin printing information on a recording medium in each scan axis direction. Otherwise, any misalignment of the carriage will result in a misregistration of print images, particularly when the printer is a multi-color type of printer. One conventional approach for positioning the recording head mounted on the carriage at its home position is disclosed in Furukawa '867 in which a home position sensor including a light emitting diode and a photo transistor is used to determine whether a carriage is at its home position. Another conventional approach may be described, for example, in U.S. Pat. No. 5,289,208 for *Automatic Print Cartridge Alignment Sensor System* issued to Haselby and U.S. Pat. No. 5,451,990 for *Reference Pattern For Use In Aligning Multiple Inkjet Cartridges* issued to Sorenson et al., in which an optical sensor mounted on a carriage assembly is used to determine the position of the carriage based on an encoded test pattern. However, these conventional home position sensor systems are susceptible to noise, and require excess power and time consumption. As a result, an improved home position sensor system can be contemplated not only to minimize power consumption and time requirement for sensing a home position of a carriage supporting a removable print cartridge containing a recording head so as to accurately print information on a recording medium and to determine whether a removable print cartridge is mounted on a carriage.

SUMMARY OF THE INVENTION

Accordingly, it is therefore an object of the present invention to provide an improved home position sensor system and process for a printing apparatus.

It is another object to provide an improved home position sensor system capable of efficiently sensing a home position of a carriage supporting a recording head for accurately beginning printing information on a recording medium with minimal noise, and reduced power and time requirement.

It is still another object to provide an improved home position sensor system capable of efficiently sensing a home position of a carriage supporting a removable print cartridge containing a recording head for beginning printing information on a recording medium while concomitantly determining whether a removable print cartridge is mounted on a carriage.

These and other objects of the present invention can be achieved by a printing apparatus comprising a printer frame and a carriage mounted on the printer frame and having a recording head mounted thereon for printing on a recording medium. The carriage is movable in a predetermined direction relative to the recording medium. First and second sensing ribs are separately mounted on the carriage along the predetermined direction relating to the recording medium. A home sensor is mounted on the printer frame at one end of the predetermined direction for sensing a home position representing an initial reference position for enabling the recording head to accurately begin printing on the recording medium along each predetermined direction. A carriage driver mechanism is mounted on the printer frame for driving the carriage to move along the predetermined direction relative to the recording medium. A controller is connected to the carriage driver mechanism for controlling the movement of the carriage along the predetermined direction during printing and for positioning the carriage at the home position upon detection of the first and second sensing ribs by the home sensor.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 5 is a flow chart illustrating a control operation for sensing a home position according to the principles of the present invention;

FIGS. 6A to 6C are diagrammetric views showing operational states between a pair of sensing ribs and a home sensor according to positions of a carriage as contemplated by the present invention;

FIGS. 7A to 7D are diagrammetric views showing another operational states between a pair of sensing ribs and a home sensor according to positions of a carriage as contemplated by the present invention;

FIGS. 9A to 9D are diagrammetric views showing another operational states between a pair of sensing ribs and a home sensor according to positions of a carriage as contemplated by the present invention.

DETAILED DESCRIPTION OF THE PREFERRED EMBODIMENT

Figure 1:
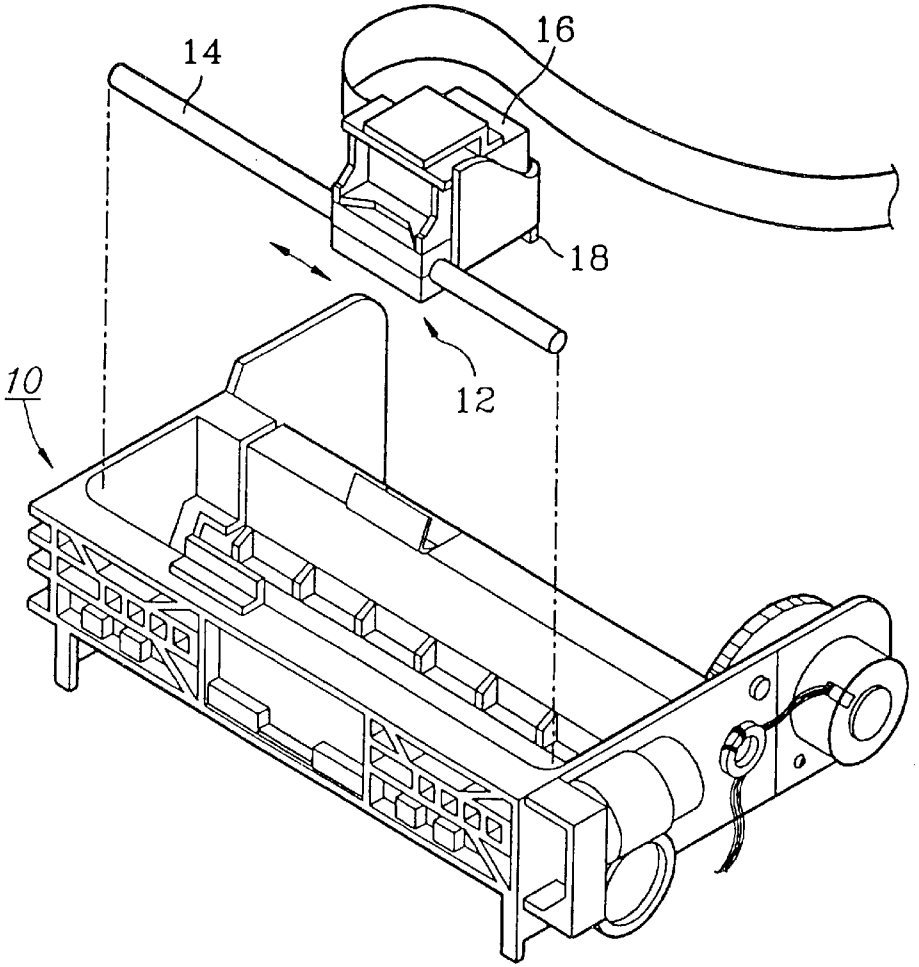
FIG. 1 illustrates an abstract representation of a typical carriage mechanism in representative ink jet printer constructed according to the principles of the present invention.

Refer now to the drawings and particularly to FIG. 1, which illustrates an abstract representation of a conventional carriage mechanism in a representative ink jet printer constructed according to the principles of the present invention. The inkjet printer includes a frame 10, a guide rail 14 having opposite ends mounted to the frame 10, and a movable carriage 12 mounted on a guide rail 14 for translational movement along a carriage scan axis i.e., horizontal direction. The carriage 12 contains an ink cartridge 16 mounted thereon and is driven by a carriage motor (not shown) to move in the horizontal direction along the guide rail 14. The ink cartridge 16 is typically an integrated ink receptacle having a recording head and can be replaceable when the ink contained therein is exhausted. When the carriage 12 is driven along the guide rail 14, the ink cartridge 16 moves along with the carriage 12 to print information data on a recording medium. The carriage 12 also includes a sensing rib 18 mounted on a corner of its bottom surface and protruded therefrom for allowing a corresponding home sensor 20 mounted on one side of a moving path of the carriage 12 to determine whether the carriage 12 supporting the ink cartridge 16 is at a home position. The sensing rib 18 and the corresponding home sensor 20 which in combination constitute a typical home position sensor system.

Figure 2A:
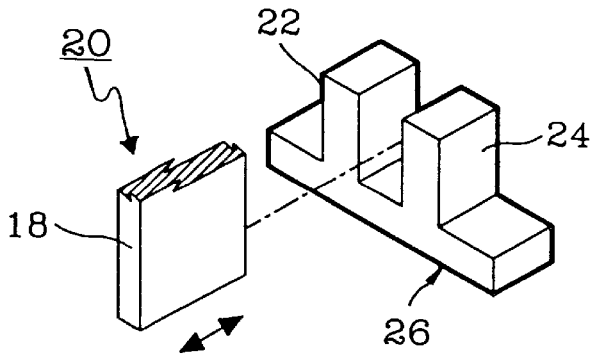
FIGS. 2A and 2B are perspective views illustrating operational relationship between a home sensor and a sensing rib of the typical home position sensor system as shown in FIG. 1.
Figure 2B:
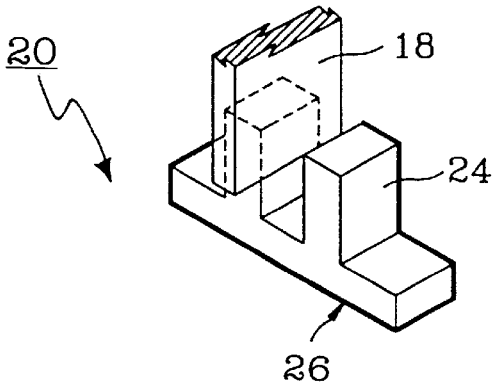

FIGS. 2A and 2B illustrate operational relationship between a home sensor 20 and a sensing rib 18 of the typical home position sensor system of FIG. 1. FIGS. 2A and 2B illustrate a home sensor 20 in a general U-shape and having a light emitting portion 22 and a light receiving portion 24 extending in parallel from a base portion, 26 and a sensing rib 18 having a plate shape extended downwardly from the bottom surface of the carriage 12. FIG. 2A illustrates a positional relationship between the sensing rib 18 and the home sensor 20 as the sensing rib 18 is about to pass through the home sensor 20. FIG. 2B illustrates a positional relationship between the sensing rib 18 and the home sensor 20 as the sensing rib 18 passes through the home sensor 20 informing that the carriage 12 is to be positioned at a home position. As shown in FIGS. 2A and 2B, the home sensor 20 is an optical type comprised of the light emitting portion 22 and the light receiving portion 24. However, a contact sensor may be used in place of the optical sensor. The home sensor 20 is positioned at either a leftmost or rightmost portion in the moving path of the carriage 12.

Under this arrangement, when the carriage 12 moves along the guide rail 14 in the horizontal direction and where the sensing rib 18 is deviated from the home sensor 20 as shown in FIG. 2A, the light emitted from the light emitting portion 22 is received by the light receiving portion 24 to indicate that the carriage 12 is not close to a home position. As a result, the home sensor 20 is turned "off." However, where the sensing rib 18 passes between the light emitting portion 22 and the light receiving portion 24 of the home sensor 20, an optical path therebetween is cut off by the sensing rib 18 to thereby indicate that the carriage 12 is close to a home position. As a result, the home sensor 20 is turned "on." Consequently, the home sensor 20 is turned "on" or "off" in dependence upon the position of the carriage 12, and the printer's controller continually checks a sensing state of the home sensor 20 so as to determine whether the carriage 12 is currently placed at the home position.

Upon an initial operation of the printer, the controller determines that the carriage 12 is placed at the home position when the home sensor 20 is turned "on" so as to begin printing information on a recording medium in each scan axis direction. When the home sensor 20 is turned "off", however, the controller determines the carriage 12 is not placed at the home position. In this situation, since the carriage 12 must be placed in the direction opposite to the home position except when the printer is out of order, the controller allows the carriage 12 to move in the direction of the home position and continually checks the sensing state of the home sensor 20. Thus, as the carriage 12 reaches the home position, the home sensor 20 is turned "on" by the sensing rib 18 so that the controller can perform the initial printing operation. The direction of home position indicates the direction towards which the home sensor 20 is disposed and the direction opposite to the home position indicates the direction against which the home sensor 20 is disposed.

At this time, the carriage 12 moves at a lower speed than the moving speed for printing information on a recording medium. When the carriage 12 moves along the guide rail 14 at a lower speed, noise is of an unacceptable level generated from the carriage motor, in comparison to the noise generated while the carriage 12 is moving at high speed. Power consumption is also increased because overcurrent is required to control the carriage 12 at low speed. In the case where the carriage 12 is close to the home position, the time required for the home sensor 20 to sense the home position is relatively short. However, in the case where the carriage 12 is far away from the home position, the time required for the home sensor 20 to sense the home position is relatively long. This results in an unnecessary time delay in the processing of print information. Moreover, when the ink contained in the ink cartridge 16 is exhausted and the ink cartridge 16 need to be replaced, the typical inkjet printer requires an additional detection pin for detecting whether ink is contained in the ink cartridge or a recording head is mounted on the carriage. This requirement is, however, burdensome.

Figure 3:
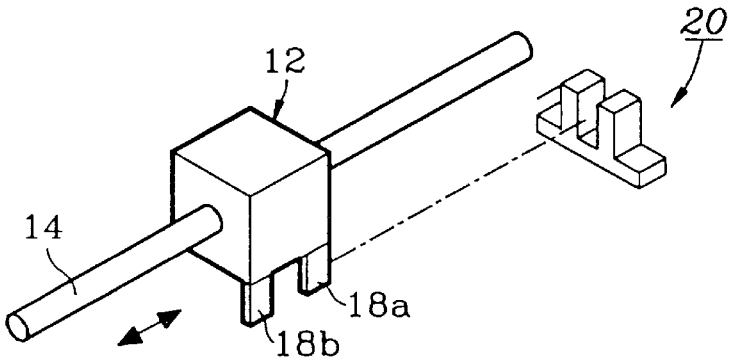
FIG. 3 is a perspective view illustrating a home position sensor system including a home sensor and a pair of sensing ribs constructed according to the principles of the present invention.

Turning now to FIG. 3 which illustrates an improved home position sensor system including a home sensor and a pair of sensing ribs constructed according to the principles of the present invention. The home position sensor system includes two sensing ribs 18*a* and 18*b* separately disposed at each bottom comer of a carriage 12 extending from its bottom surface to move along the horizontal direction of the carriage 12. A first sensing rib 18*a* serves as a secondary sensing rib for controlling the position of the carriage 12 moving along the horizontal direction during printing. A second sensing rib 18*b* serves as a reference sensing rib for positioning the carriage 12 at a home portion to begin printing on a recording medium along the horizontal direction. A single home sensor 20 is provided at one side end of the moving path of the carriage 12 so as to sense a sensing state of the sensing ribs 18*a* and 18*b*. After the carriage 12 moves so that a first sensing rib 18*a* is sensed by the home sensor 20, the carriage 12 then moves further so that then a second reference sensing rib 18*b* is sensed by the home sensor 20 in order to sense the home position.

Figure 4:
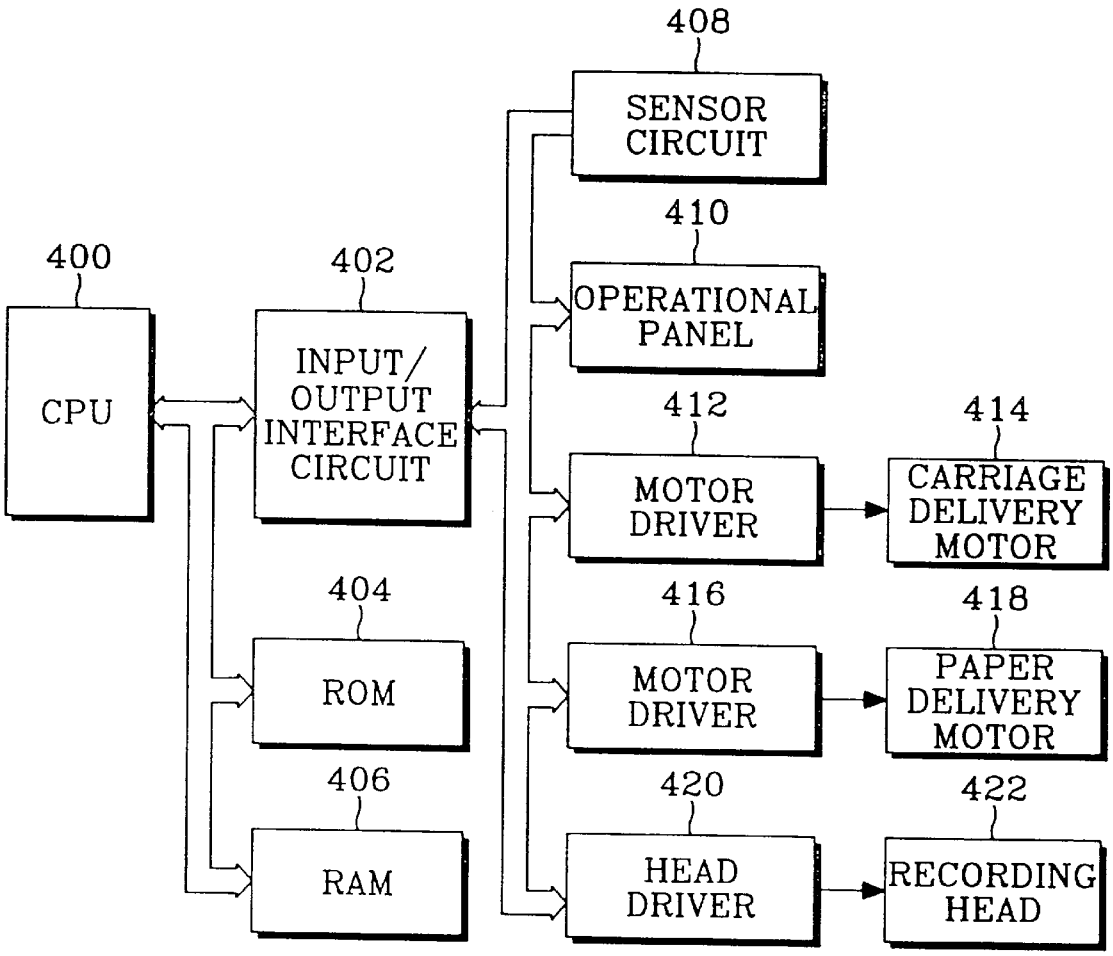
FIG. 4 is a block diagram illustrating a representative ink jet printer constructed according to the principles of the present invention.

Refer now to FIG. 4 which illustrates the operation of a representative ink jet printer having an improved home sensor system constructed according to the principles of the present invention including two sensing ribs 18*a* and 18*b* and a home sensor 20 incorporated therein to sense whether a carriage is at a home position. Generally, the inkjet printer as shown in FIG. 4 includes a central processing unit (CPU) 400 for controlling operation of the printer based a program stored in a read-only-memory (ROM) 404, an input/out interface circuit 402 for interfacing with a sensor circuit 408, an operational panel 410, a first motor driver 412 for driving a carriage delivery motor 414, a second motor driver 416 for driving a paper delivery motor 418 and a head driver 420 for driving a recording head 422 of the ink cartridge. The CPU 400 executes an application program stored in ROM 404, and temporarily stores data resulted therefrom in a random access memory (RAM) 406. The sensor circuit 408 includes a home position sensor system and various sensors for sensing the operational status of each hardware component of the inkjet printer such as a paper feeding and delivering state, the amount of ink contained in the ink cartridge. The operational panel 410 includes a plurality of keys for allowing a user to enter all kinds of commands and a display unit for providing a visual display of various operational status under control of the CPU 400. The motor driver 412 serves to drive a carriage delivery motor 414 under control of the CPU 400. The carriage delivery motor 414 enables the carriage 12 to move along the guide rail 14 in the horizontal direction. The motor driver 416 serves to drive a paper delivery motor 418 under control of the CPU 400. The paper delivery motor 418 enables a printable medium such as paper to be delivered. The head driver 420 drives a recording head 422 provided with the ink cartridge 16 under control of the CPU 400 and records image data onto the printable medium. The recording head 422 has a plurality of nozzles and is driven by the head driver 420 to disperse the ink through the nozzles, thereby recording image data onto the printable medium.

Under the ink jet printer as described in FIG. 4, an embodiment where the sensing ribs 18*a* and 18*b* and home sensor 20 are applied to sense the home position will be described with reference to FIG. 5.

Figure 8A:
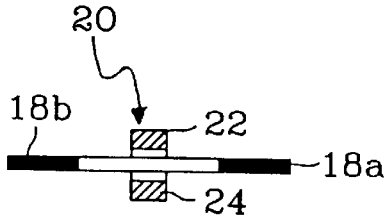
FIGS. 8A to 8E are diagramrnetric views showing yet another operational states between a pair of sensing ribs and a home sensor according to positions of a carriage as contemplated by the present invention.

When power of the printer is turned "on", the CPU 400 checks the sensing state of the home sensor 20 applied from the sensor circuit 408 to determine whether the home sensor 20 is turned "on" at step 400. At this time, the two sensing ribs 18*a* and 18*b* are in one of four states as shown in FIGS. 6A through 9D according to the position of the carriage 12 before the power of printer is "on". FIGS. 6A and 7A show examples where one of the two sensing ribs 18*a* and 18*b* is sensed by the home sensor 20. In FIG. 6A, a second sensing rib 18*b* is sensed by the home sensor 20, whereas in FIG. 7A, a first sensing rib 18*a* is sensed by the home sensor 20. FIGS. 8A and 9A show examples where all of the two sensing ribs 18*a* and 18*b* are not sensed by the home sensor 20. In FIG. 8A, the home sensor 20 is disposed between the sensing ribs 18*a* and 18*b*, and in FIG. 9A, all of the sensing ribs 18*a* and 18*b* are positioned away from the home sensor 20. Of course, in FIGS. 6A through 9D, the position of the sensing ribs 18*a* and 18*b* in relation to the home sensor 20 may be adjusted in a vertical direction, but the sensing state of the home sensor 20 remains the same as above.

Only one of the two sensing ribs 18*a* and 18*b* is used as a reference sensing rib by the home sensor 20, in the case where the carriage 12 is in the home position, as shown in FIGS. 6A through 9D. In the following description, it is assumed that a second sensing rib 18*b* is set as the reference sensing rib. It is further assumed that when one of the two sensing ribs 18*a* and 18*b* is sensed by the home sensor 20, that is, when the light emitted from the light emitting portion 22 to the light receiving portion 24 of the home sensor 20 is cut off by the passing of the sensing ribs 18*a* and 18*b*, the state where the home sensor is turned "on" is defined as "a home sensing state".

Under the above state, in the case where the home sensing state is obtained at step 500 as shown in FIGS. 6A and 7A, CPU 400 drives the carriage motor 414 through the motor driver 412 at step 502 and moves the carriage 12 at a low speed by a first predetermined distance "X" in the direction opposite to the home position, and then checks whether the home sensing state is obtained at step 504. At this time, if a previous home sensing state corresponds to that of FIG. 6A, the home sensing state is obtained as shown in FIG. 6B. By contrast, if the previous home sensing state corresponds to that of FIG. 7A, the home sensing state is not obtained as shown in FIG. 7B. The first distance "X" is set to be equal to the distance between the center axes of the horizontal widths of the two sensing ribs 18*a* and 18*b*. However, the first distance "X" may be set differently without departing from the scope of the present invention.

When the home sensing state is obtained at step 504, CPU 400 drives the carriage motor 414 through the motor driver 412 and moves the carriage 12 at a low speed by the first distance "X" in the direction of the home position at step 506. Since the positional relationship between the sensing rib 18*a* and 18*b* and the home sensor 20 is changed from FIG. 6B to FIG. 6C, the reference sensing rib 18*b* is sensed to the home sensor 20, that is, the home sensing state is obtained. Thereafter, CPU 400 terminates the home position sensing operation and typically performs initial printing operation.

When the home sensing state is not obtained at step 504, however, CPU 400 drives the carriage motor 414 through the motor driver 412 and moves the carriage 12 at a low speed in the direction of the home position at step 524. CPU 400 then sequentially checks whether the home sensing state is obtained twice at step 526. Since the relationship between the sensing rib 18*a* and 18*b* and the home sensor 20 is changed in order of the states of FIG. 7B, FIG. 7C and FIG. 7D, the reference sensing rib 18*b* is sensed by the home sensor 20, that is, the home sensing state is obtained. Thereafter, CPU 400 terminates the home position sensing operation and typically performs the initial printing operation.

Therefore, in the case where one of the sensing rib 18*b* is sensed by the home sensor 20, as shown in FIGS. 6A and 7A, the carriage 12 sequentially moves at a low speed in the direction opposite to the home position and in the direction of the home position within the first distance "X" so as to allow the home sensor 20 to sense the reference sensing rib 18*b*.

Figure 8B:
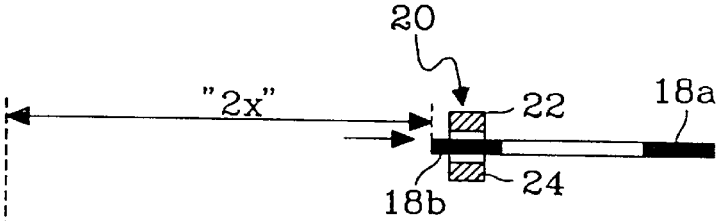
Figure 8C:
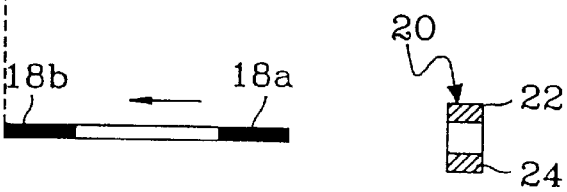
Figure 8D:
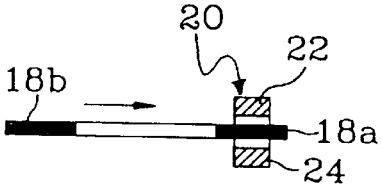
Figure 8E:
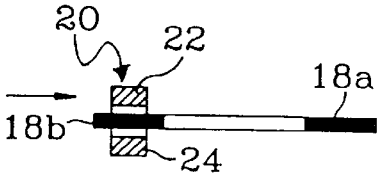

In the meanwhile, when the home sensing state is not obtained at step 500 as shown FIGS. 8A and 9A, CPU 400 at steps 508 to 512 drives the carriage motor 414 through the motor driver 412 and moves the carriage 12 at a low speed by a second predetermined distance "2X" in the direction of the home position, and then checks whether the home sensing state is "on". At this time, if a previous home sensing state corresponds to that of FIG. 8A, the home sensing state is obtained as shown in FIG. 8B before the carriage 12 moves by the second distance "2X". By contrast, if the previous home sensing state corresponds to that of FIG. 9A, the home sensing state is not obtained as shown in FIG. 9B after the carriage 12 completes the movement by the second distance "2X". The second distance "2X" is set to be twice as long as the first distance "X". However, in the same manner as the first distance "X", the second "2X" may be set differently without departing from the scope of the present invention.

At steps 508 to 512, when the home sensing state is obtained before the carriage 12 completes the movement to the second distance "2X", CPU 400 drives the carriage motor 414 through the motor driver 412 and moves the carriage 12 at a low speed by the second distance "2X" in the direction opposite to the home position at step 522. Then, CPU 400 checks at two discrete times whether the home sensing state is obtained, while moving at a low speed the carriage 12 in the direction of the home position. At this time, since the relationship between the sensing rib 18*a* and 18*b* and the home sensor 20 is changed in order of the states of FIG. 8C, FIG. 8D and FIG. 8E, the reference sensing rib 18*b* is sensed by the home sensor 20, that is, the home sensing state is obtained. Thereafter, CPU 400 terminates the home position sensing operation, and performs the initial printing operation.

Therefore, in the case where no sensing ribs 18*a* and 18*b* are sensed by the home sensor 20, as shown in FIG. 8A, the carriage 12 moves at a low speed in the direction of the home position within the second distance "2X". Thus, when the sensing rib 18*b* is sensed, the carriage 12 moves at a low speed by the second distance "2X" in the direction opposite to the home position so as to determine whether a reference sensing rib 18*b* is sensed by the home sensor 20.

At steps 508 to 512, on the other hand, when the home sensing state is not obtained after the carriage 12 completes the movement to the second distance "2X" as shown in FIG. 9B, CPU 400 drives the carriage motor 414 through the motor driver 412 and moves the carriage 12 at a high speed in the direction of the home position at step 514 so as to determine whether the home sensing state is obtained at step 516. When the state of FIG. 9B is changed to that of FIG. 9C, that is, the home sensing state is obtained, CPU 400 checks whether the home sensing state is obtained at step 520, while moving at a low speed the carriage 12 in the direction of the home position at step 518. At this time, since the relationship between the sensing rib 18*a* and 18*b* and the home sensor 20 is changed in the order of the operational states shown in FIGS. 9B to 9D, the reference sensing rib 18*b* is sensed by the home sensor 20, that is, the home sensing state is obtained. Thereafter, CPU 400 terminates the home position sensing operation, and performs the initial printing operation.

Therefore, in the case where no sensing ribs 18*a* and 18*b* are sensed by the home sensor 20 as shown in FIG. 9A, the carriage 12 moves at a low speed in the direction of the home position up to the second distance "2X". Thus, when the sensing rib 18*a* is not sensed by the home sensor 20, the CPU 400 moves at a high speed the carriage 12 in the direction of the home position until the sensing rib 18*a* is sensed. Then, the CPU 400 moves at a low speed the carriage 12 in the direction of the home position so as to allow the home sensor 20 to sense the reference sensing rib 18*b*.

The low speed movement as described above indicates the state where the carriage 12 moves at a lower speed than the moving speed of printing, and the high speed movement indicates the state where the carriage 12 moves at a higher speed than the moving speed of printing. Accordingly, in the conventional printer, the carriage 12 moves at the low speed irrespective of the previous state of the position of carriage 12 so as to sense the home position. The present invention, however, requires the carriage 12 to move at the low speed only during a short interval in accordance with the position of carriage 12 in order to minimize the amount of time required to sense the home position. As a result, the time consumption taken from the time point of the power "on" to the initial printing operation can be reduced. In addition, noise and power consumption required because of the movement of the carriage performing the home position can also be reduced.

As an alterative embodiment, the sensing ribs 18*a* and 18*b* can be placed in the recording head 422 instead of the carriage 12 of the ink jet printer so that the recording head 422 can cooperate with the home sensor 20. In this situation, when the recording head 422 is not mounted on the carriage 12, the carriage 12 moves but the sensing ribs 18*a* and 18*b* are not sensed by the home sensor 20. Therefore, if the carriage 12 moves along the guide rail 14 in all movable intervals but no sensing ribs 18 and 18*b* are sensed by the home sensor 20, CPU 400 determines that the recording head 422 is not mounted on the carriage 12. That is, the home sensor 20 is not turned "on" until the carriage 12 completely moves in the direction of the home position at steps 514 to 516, the CPU 400 determines that the recording head 422 is not mounted on the carriage 12. Accordingly, the sensing ribs 18*a* and 18*b* are used for sensing the home position as well as for detecting whether the recording head 422 is mounted in the printer, without installation of additional detection pins to the recording head 422 as necessarily required by the conventional printer.

As set forth above, the present invention provides a home position sensor system that effectively shortens the amount of time required for sensing a home position and reducing noise caused while moving a carriage along a guide rail to sense a home position. Furthermore, the present invention provides a home position sensor system that efficiently reduces the power consumption while moving a carriage along a guide rail to sense a home position without requiring installation of additional detection pins.

While the present invention has been described with reference to a few specific embodiments, the description is illustrative of the invention and is not to be construed as limiting the invention. Particularly, the present invention embodies that the sensing rib 18*b* is set as the reference sensing rib, but the sensing rib 18*a* may be set as that. Further, the present invention is embodied in the ink jet printer, but may be embodied in a dot matrix printer or plotter in which the home position sensing operation is required. Various modifications may occur to those skilled in the art without departing from the true spirit and scope of the invention as defined by the appended claims.

What is claimed is:

1. A printing apparatus, comprising:

a printer frame;

a carriage movably mounted on said printer frame and having a recording head mounted thereon, for printing onto a recording medium, said carriage being movable in a predetermined axis relative to said recording medium;

a first sensing rib and a second sensing rib separately mounted on said carriage along said predetermined axis relative to said recording medium;

a home sensor mounted on said printer frame at one end of said predetermined axis, for sensing whether said carriage passes through a home position representing an initial reference position for enabling said recording head mounted on said carriage to begin printing on said recording medium along said predetermined axis;

a carriage driver for driving said carriage to move along said predetermined axis relative to said recording medium; and a controller for controlling the movement of said carriage along said predetermined axis to position said carriage at said home position upon initialization for enabling printing on said recording medium, said controller controlling said carriage driver to move said carriage at high speed in a direction toward said home position until detection of a first one of said first sensing rib and said second sensing rib by said home sensor, and then to move said carriage at low speed in the direction toward said home position until detection of a second one of said first sensing rib and said second sensing rib by said home sensor.

2. The printing apparatus of claim 1, further comprised of said second sensing rib serving as a reference sensing rib so that, when said second sensing rib is sensed by said home sensor as said second sensing rib mounted on said carriage passes through said home sensor, said home sensor determines that said carriage is at said home position for enabling said recording head to begin printing on said recording medium along said predetermined axis.

3. The printing apparatus of claim 1, further comprised of said home sensor comprising a base portion, a light emitting portion and a light receiving portion extending in parallel from said base portion, said light emitting portion emitting a light to be received by said light receiving portion when neither said first sensing rib nor said second sensing rib separately mounted on said carriage passes through said light emitting portion and said light receiving portion indicating that said home sensor is turned "off."

4. The printing apparatus of claim 3, further comprised of said home sensor tuning "on" when any one of said first sensing rib and said second sensing rib separately mounted on said carriage passes through said light emitting portion and said light receiving portion.

5. The printing apparatus of claim 1, further comprised of said controller moving said carriage along said predetermined axis until a first one of said first sensing rib and second sensing rib is detected by said home sensor, moving said carriage by a first distance in the direction away from said home position and determining whether a second one of said first sensing rib and said second sensing rib is detected by said home sensor, and when said second one of said first sensing rib and said second sensing rib is detected by said home sensor, moving said carriage by said first distance in the direction toward said home position to position said carriage at said home position to begin printing on said recording medium along said predetermined axis.

6. The printing apparatus of claim 5, further comprised of said controller controlling the movement of said carriage by:

determining whether said first one of said first sensing rib and said second sensing rib is detected by said home sensor;

moving said carriage in the direction toward said home position while determining whether said first one of said first sensing rib and said second sensing rib is detected by said home sensor, when said first one of said first sensing rib and said second sensing rib is not detected by said home sensor;

determining whether said carriage has moved by a second distance, when neither said first sensing rib nor said second sensing rib is detected by said home sensor;

moving said carriage at high speed in the direction toward said home position until said first one of said first sensing rib and said second sensing rib is detected by said home sensor;

when said first one of said first sensing rib and said second sensing rib is detected by said home sensor, moving said carriage at low speed in the direction toward said home position until said second one of said first sensing rib and said second sensing rib is detected by said home sensor; and positioning said carriage at said home position to begin printing on said recording medium along said predetermined axis.

7. The printing apparatus of claim 6, further comprised of said controller moving said carriage by said second distance in the direction away from said home position, when said first one of said first sensing rib and said second sensing rib is detected by said home sensor while said carriage is moving in the direction toward said home position, and moving said carriage back in the direction toward said home position until both said first sensing rib and said second sensing rib are sequentially detected by said home sensor so as to position said carriage at said home position to begin printing on said recording medium along said predetermined axis.

8. The printing apparatus of claim 7, further comprised of said first distance corresponding to a predetermined spacing between said first sensing rib and said second sensing rib separately mounted on said carriage, and said second distance corresponding to twice said first distance.

9. A printing apparatus, comprising:

a carriage movably mounted on a printer frame and having a recording head mounted thereon for printing onto a recording medium, said carriage being movable in a predetermined axis relative to said recording medium;

first and second sensing ribs separately mounted on said carriage along said predetermined axis relative to said recording medium;

a home sensor mounted on said printer frame at one end of said predetermined axis, for sensing whether said carriage passes through a home position representing an initial reference position for enabling said recording head mounted on said carriage to begin printing on said recording medium along said predetermined axis;

a carriage driver for driving said carriage to move along said predetermined axis relative to said recording medium; and a controller for controlling the movement of said carriage along said predetermined axis at one of high speed and low speed to position said carriage at said home position upon initialization in dependence upon detection of said first sensing rib and said second sensing rib by said home sensor.

10. The printing apparatus of claim 9, further comprised of said second sensing rib serving as a reference sensing rib so that, when said second sensing rib is sensed by said home sensor as said second sensing rib mounted on said carriage passes through said home sensor, said home sensor determines that said carriage is at said home position for enabling said recording head to begin printing on said recording medium along said predetermined axis.

11. The printing apparatus of claim 10, further comprised of said home sensor comprising a base portion, a light emitting portion and a light receiving portion extending in parallel from said base portion, said light emitting portion emitting a light to be received by said light receiving portion when neither said first sensing rib nor said second sensing rib separately mounted on said carriage passes through said light emitting portion and said light receiving portion indicating that said home sensor is turned "off."

12. The printing apparatus of claim 11, further comprised of said home sensor turning "on" when any one of said first sensing rib and said second sensing rib separately mounted on said carriage passes through said light emitting portion and said light receiving portion.

13. The printing apparatus of claim 9, further comprised of said controller moving said carriage along said predetermined axis until a first one of said first sensing rib and said second sensing rib is detected by said home sensor, moving said carriage by a first distance in the direction away from said home position and determining whether a second one of said first sensing rib and said second sensing rib is detected by said home sensor, and when said second one of said first sensing rib and said second sensing rib is detected by said home sensor, moving said carriage by said first distance in the direction toward said home position to position said carriage at said home position to begin printing on said recording medium along said predetermined axis.

14. The printing apparatus of claim 9, further comprised of said controller controlling the movement of said carriage by:

determining whether a first one of said first sensing rib and said second sensing rib is detected by said home sensor;

moving said carriage in the direction toward said home position while determining whether said first one of said first sensing rib and said second sensing rib is detected by said home sensor, when said first one of said first sensing rib and said second sensing rib is not detected by said home sensor;

determining whether said carriage has moved by a second distance, when neither said first sensing rib nor said second sensing rib is detected by said home sensor;

moving said carriage at high speed in the direction toward said home position until said first one of said first sensing rib and said second sensing rib is detected by said home sensor;

when said first one of said first sensing rib and said second sensing rib is detected by said home sensor, moving said carriage at low speed in the direction toward said home position until a second one of said first sensing rib and said second sensing rib is detected by said home sensor; and positioning said carriage at said home position to begin printing on said recording medium along said predetermined axis.

15. The printing apparatus of claim 14, further comprised of said controller moving said carriage by said second distance in the direction away from said home position, when said first one of said first sensing rib and said second sensing rib is detected by said home sensor while said carriage is moving in the direction toward said home position, and moving said carriage back in the direction toward said home position until both said first sensing rib and said second sensing rib are sequentially detected by said home sensor so as to position said carriage at said home position to begin printing on said recording medium along said predetermined axis.

16. The printing apparatus of claim 9, further comprised of said controller moving said carriage in the direction toward said home position to determine whether said first and second sensing ribs are detected by said home sensor, and when neither said first sensing rib nor said second sensing rib is detected by said home sensor, determining that said recording head is not mounted on said carriage.

17. The printing apparatus of claim 15, further comprised of said first distance corresponding to a predetermined spacing between said first sensing rib and said second sensing rib separately mounted on said carriage, and said second distance corresponding to twice said first distance.

18. A home position sensing method of a printer comprising a carriage having a recording head a first sensing rib and a second sensing rib separately mounted on said carriage, and a home sensor for sensing whether said carriage passes through a home position to enable said recording head to begin printing on a recording medium, said method comprising the steps of:

determining whether a first one of said first sensing rib and said second sensing rib is detected by said home sensor;

when said first one of said first sensing rib and said second sensing rib is detected by said home sensor, moving said carriage at low speed by a first distance in a direction away from said home position;

determining whether a second one of said first sensing rib and said second sensing rib when said second one of said first sensing rib and said second sensing rib is not detected by said home sensor, moving said carriage at low speed in a direction toward said home position until said first sensing rib and said second sensing rib are sequentially detected by said home sensor to position said carriage at said home position to begin printing on said recording medium along a predetermined axis; and when said second one of said first sensing rib and said second sensing rib is detected by said home sensor, moving said carriage at low speed by said first distance in the direction toward said home position to position said carriage at said home position to begin printing on said recording medium along said predetermined axis.

19. The home position sensing method of claim 18, further comprising:

when said first one of said first sensing rib and said second sensing rib is not detected by said home sensor, moving said carriage at low speed in the direction toward said home position while determining whether said first one of said first sensing rib and a second sensing rib is detected by said home sensor;

determining whether said carriage has moved by a second distance, when neither said first sensing rib nor said second sensing rib is detected by said home sensor;

moving said carriage at high speed in the direction toward said home position until said first one of said first sensing rib and said second sensing rib is detected by said home sensor;

when said first one of said first sensing rib and said second sensing rib is detected by said home sensor, moving said carriage at low speed in the direction toward said home position until said second one of said first sensing rib and said second sensing rib is detected by said home sensor; and positioning said carriage at said home position to begin printing on said recording medium along said predetermined axis.

20. The home position sensing method of claim 19, further comprising:

moving said carriage at low speed by said second distance in the direction away from said home position, when said first one of said first sensing rib and said second sensing rib is detected by said home sensor while said carriage moves at low speed in the direction toward said home position; and moving said carriage at low speed in the direction toward said home position until both said first sensing rib and said second sensing rib are sequentially detected by said home sensor so as to position said carriage at said home position to begin printing on said recording medium along said predetermined axis.

21. The home position sensing method of claim 20, further comprised of said first distance corresponding to a predetermined spacing between said first sensing rib and said second sensing rib separately mounted on said carriage.

22. The home position sensing method of claim 21, further comprised of said second distance corresponding to twice said first distance.

23. A process of positioning a carriage of a printer at a home position upon initialization, comprising the steps of:

moving said carriage having a first sensing rib and a second sensing rib separately mounted thereon, at high speed in a direction toward a home position serving as a starting position for beginning printing information on a recording medium until a first one of said first sensing rib and said second sensing rib passes through said home position;

when said first one of said first sensing rib and said second sensing rib passes through said home position, moving said carriage at low speed in the direction toward said home position until a second one of said first sensing rib and said second sensing rib passes through said home position; and positioning said carriage at said home position to begin printing on said recording medium along a predetermined axis.

24. The process of claim 23, further said printer comprising a home sensor for sensing movement of said carriage along said predetermined axis, said home sensor including a base portion, a light emitting portion and a light receiving portion extending in parallel from said base portion, said light emitting portion emitting a light to be received by said light receiving portion to determine whether one of said first sensing rib and said second sensing rib separately mounted on said carriage passes through said light emitting portion.

* * * * *